US006810994B2

(12) United States Patent
Trask

(10) Patent No.: US 6,810,994 B2
(45) Date of Patent: Nov. 2, 2004

(54) ACTUATOR FOR CAMMING DEVICES

(76) Inventor: Brian C. Trask, 3601 E. Hermes Dr., Salt Lake City, UT (US) 84124

( * ) Notice: Subject to any disclaimer, the term of this patent is extended or adjusted under 35 U.S.C. 154(b) by 0 days.

(21) Appl. No.: 10/309,666

(22) Filed: Dec. 3, 2002

(65) Prior Publication Data

US 2003/0102185 A1 Jun. 5, 2003

Related U.S. Application Data

(60) Provisional application No. 60/337,536, filed on Dec. 3, 2001.

(51) Int. Cl.[7] ..... A47L 3/04; A47F 5/08

(52) U.S. Cl. ..... 182/3; 248/925; 248/231.9

(58) Field of Search ..... 182/3, 5, 90; 248/925, 248/231.9, 231.91; 482/37

(56) References Cited

U.S. PATENT DOCUMENTS 4,712,754 A * 12/1987 Brodie ..... 248/231.9
4,715,568 A * 12/1987 Best, Jr. ..... 248/231.9
5,934,635 A * 8/1999 Bohn ..... 248/231.9
6,092,773 A * 7/2000 Kieliszewski ..... 248/231.9
6,109,578 A * 8/2000 Guthrie et al. ..... 248/231.9
6,283,426 B1 * 9/2001 Guthrie et al. ..... 248/231.9

* cited by examiner

*Primary Examiner*—Hugh B. Thompson, II
(74) *Attorney, Agent, or Firm*—Brian C. Trask

(57) ABSTRACT

A device to retract cams of spring-loaded camming devices (SLCD) used in rock climbing protection. The device includes a retraction mechanism operable on the SLCD and a control interface to receive input from a climber's hand. A linkage of variable length is disposed between the retraction mechanism and the control interface. The linkage may be adjusted between a longer deployed length for cam retraction and a shorter length to facilitate transportation and storage of the device.

20 Claims, 3 Drawing Sheets

ACTUATOR FOR CAMMING DEVICES

RELATED APPLICATIONS

This application claims the benefit under 35 U.S.C. 119(e) of the filing date of Provisional Application Ser. No. 60/337,536, filed Dec. 3, 2001, for "ACTUATOR FOR CAMMING DEVICES".

BACKGROUND

1. Field of the Invention

This invention relates to equipment used in the sport of rock climbing. It is particularly directed to spring loaded camming devices used in such rock climbing, and provides an enhanced cam actuating mechanism.

2. State of the Art

Spring loaded camming devices (SLCDs), or commonly "cams", are advantageously used in the sport of rock free-climbing as a source of leader protection for cracks having substantially parallel sides. At times, cams placed into such cracks may "walk" under the action of friction from the rope as a climber is climbing. In such circumstance, the camming device may move deeper into the crack from the initial placement location. It is possible for a camming device to work its way sufficiently deep into a crack that a following climber may be unable to retrieve it with his/her hand. Two situations arise which create cam retrieval difficulty: either the climber's hand/fingers cannot engage the trigger due to crack constriction, or the camming device is deeper than reachable by the length of the climber's arm.

A dedicated cam actuating and retrieving device is commercially available, and is sold under the name "Friend of a friend". This device has an actuator arranged somewhat similar to a syringe, and has a fixed length of about 8–10 inches, thereby limiting the depth from which a cam may be retrieved. Nut cleaning tools are also sometimes used to retrieve cams which are unreachable by hand. Nut cleaning tools generally have one or more hooks which may be used to snag a cam's trigger, but typically provide only 6–8 inches of extension length.

Aid climbers differ from free climbers in that aid climbers may place protection in a manner similar to a free climber, but subsequently weight the placement directly as a source of purchase on the rock wall. The distance between such aid placements is necessarily limited by the span of the aid climber's arm. The time taken on each pitch of the climb is directly related to the number of required placements. Aid climbers could benefit from an extension tool to enable placement of cams at a distance further than their arm's reach. Such an extension tool could permit an aid climber essentially to leapfrog past substantially blank sections between cracks which might otherwise require considerable time and effort to craft tenuous or even dangerous placements. The aforementioned "Friend of a friend" is limited to about an 8–10 inch placement extension. Some aid climbers have used a stick-clip device to preretract the cams and stuff a cam into a crack at a distance. However, such use of the stick-clip device necessarily commits the climber to a placement that may be precarious. That is, the cam cannot be removed by the stick-clip device to try again for a better placement.

A need exists for a tool to assist in retrieving cams which walk too deep into a crack for either a free-climber or an aid-climber to remove either by hand or with the assistance of a commercially available device. It would be a further advancement if such tool provided the ability to place and remove a cam at an extended distance compared with available devices. A further advancement would be if the device provided a stick clip capability to clip a carabiner into a bolt hanger out of the reach of a climber's arm.

BRIEF SUMMARY OF THE INVENTION

The present invention provides an apparatus for actuating a cam (retracting the individual cams of a spring loaded camming device). The invention increases the distance from which a cam may be retrieved, and also permits placement and replacement of a cam at an increased distance, compared to other commercially available cam actuator devices.

Embodiments of the invention provide an actuator device, or retractor, for use in retracting the cams of a spring-loaded camming device used in rock climbing. The device functions to actuate a cam at a distance, or in a narrow space between crack walls, where a climber's arm may not reach or fit. Exemplary devices include a cam retractor configured and arranged to interface with and operate a cam's trigger, and a body having a forward member and a rear member, wherein the body may be reduced in length for transportation, and the body is disposable between the retractor and an actuator operable on the retractor. Certain embodiments have a forward body member and a rear body member being hinged whereby to fold from an in-line configuration to an approximately parallel configuration.

The device may include a pair of arms, with each arm carrying a hook on a first end, with the hook being adapted to interface with the trigger of a cam. In certain embodiments, each arm passes through a window in the body such that a portion of the arm is disposed internal to the body, and a portion is external to the body. Arms may be connected and spaced apart by a transversely oriented member. One example of the latter configuration includes a cam retractor having a pair of arms being integral to structure forming the body. Such a body may be formed from a rectangular tube.

An actuator generally includes a finger actuated remote trigger disposed at a proximal end of the rear member. In certain embodiments, the trigger is operable to move the arms. In such case, the remote trigger may be arranged to be movable toward a stationary palm end fitting. In other embodiments, the device's trigger remains stationary relative to hooks engaging a cam's trigger, while a palm or thumb operated plunger moves to actuate the cam.

A device may have an elastomeric member disposed between a forward and a rear plunger member. The elastomeric member can be biased to assist in reassembly of the plunger members when they are separated for storage.

A device can also include an adjustable link disposed between the remote trigger and the arms. In such case, the link is adjustable to create a range in operable length between a hook and a shelf of the retractor.

Devices within contemplation may include a body extension member adapted at first and second ends for in-line connection between the forward member and the rear member. Other embodiments may include a plurality of body extension members, each member being adapted at first and second ends for conjoined, in-line, connection between the forward member and the rear member.

Devices constructed according to principles of the invention may include a stick-clip element disposed at a distal device end and configured and arranged to hold a gate of a carabiner open for remote clipping to a bolt hanger.

BRIEF DESCRIPTION OF THE DRAWINGS

In the drawings, which illustrate what are currently regarded as the best modes for carrying out the invention.

DETAILED DESCRIPTION OF THE ILLUSTRATED EMBODIMENTS

Figure 1:
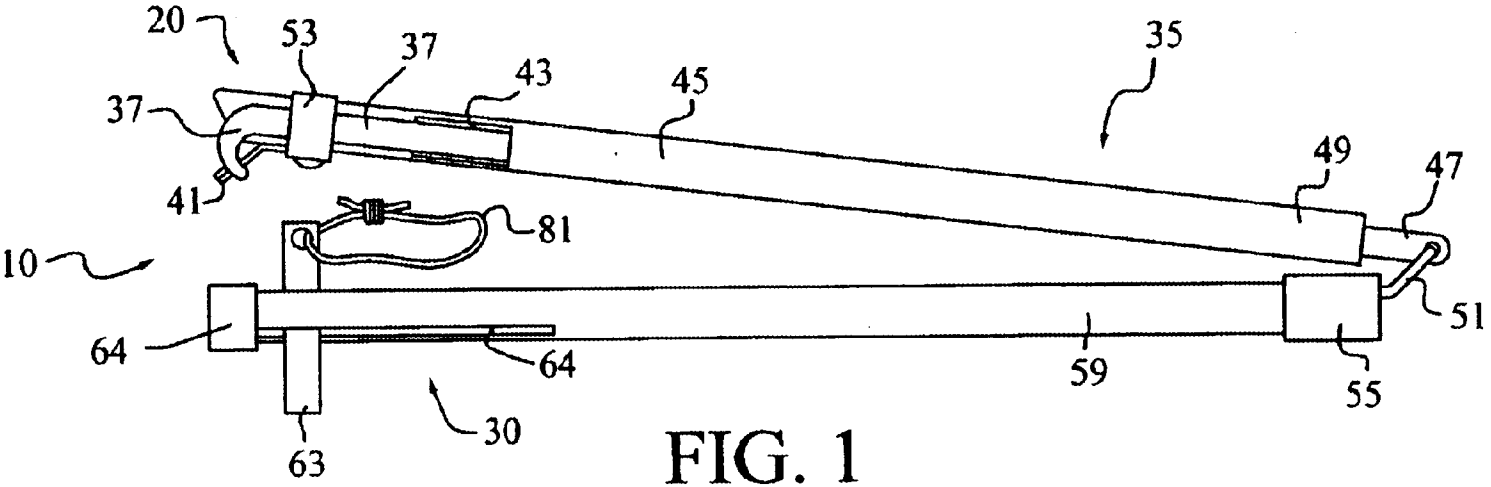
FIG. 1 is a plan view of a first embodiment of the invention, in a partially folded configuration.

A first embodiment of the invention, generally indicated at 10, is illustrated in a partially folded position in FIG. 1. The device includes a retractor portion, generally indicated at 20, and an actuator portion, generally indicated at 30. The device also includes a body, generally indicated at 35. Body 35 is disposable between, and thence spaces apart, the retractor 20 and actuator 30.

Figure 4:
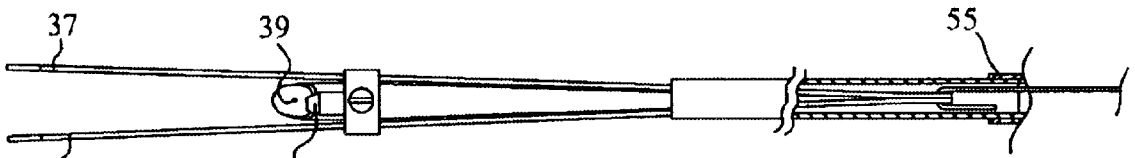
FIG. 4 is a front view, partially in section, of the retractor portion of the embodiment of FIG. 1.

A retractor portion 20 is structured operably to engage a trigger assembly of a cam and retract the cams to enable either placement of the cam into, or withdrawal of the cam from, a crack. The retractor 20 illustrated in FIGS. 1, 2, and 4 has a pair of retracting arms 37 which are adapted to grip a trigger of a cam. The opposable stem portion of a cam may be received either in a socket 39, or on a shelf 41. An opposable stem portion may be a proximal end portion of a stem, as in the case of new style Camalots and both rigid and flexible Friends. Alternatively, an opposable stem portion may be a cross bar between a pair of cables as found in old style Camalots, Metolius TCUs and four cam units, and certain other brands of cams.

Each of retracting arms 37 of the first embodiment 10 pass through a window 43 in forward body member 45. As best shown in FIG. 1, an arm 37 is desirably sized having sufficient length for a proximal end 47 to be extendable past a proximal end 49 of forward body member 45. Proximal end 47 of an arm 37 can then protrude from forward body 45 so that a forward connecting end 51 of an extension member may be connected. The arms 37 are also desirably formed to be sufficiently stiff to remain substantially in a straight alignment with body 35 during retraction of a cam. A collar 53 may be provided to assist in maintaining an approximate alignment of arms 37 with an axis of forward body member 45.

Figure 2:
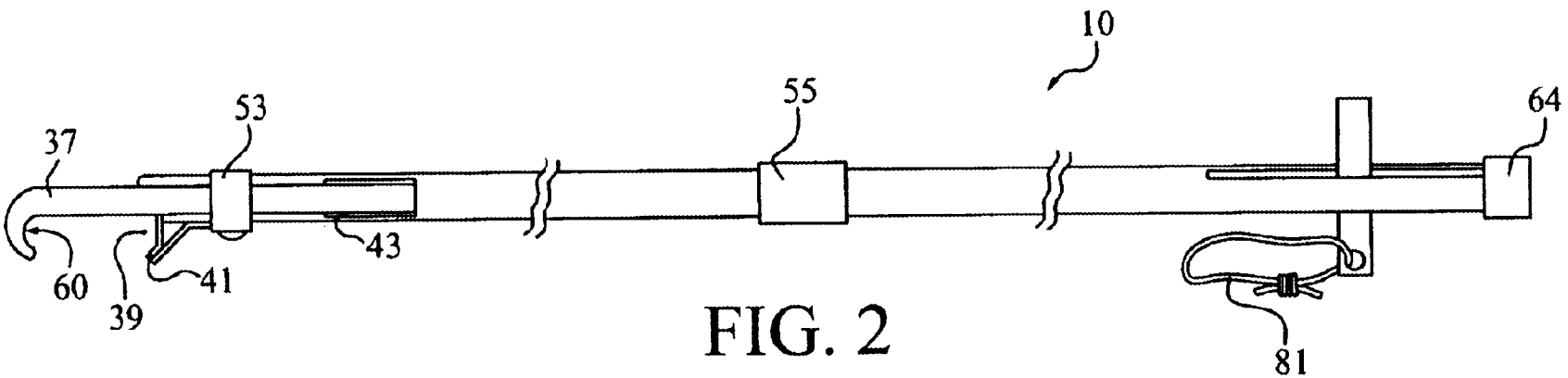
FIG. 2 is a plan view of the embodiment of FIG. 1, in a deployed configuration.

A body 35 is desirably reducible in length by telescoping, folding, separating into multiple pieces, or by some other method to reduce its length for transportation and/or storage. The body 35 illustrated in FIG. 1 is adapted to separate into multiple pieces, and also optionally, simply to fold as a plurality of linked sections. The embodiment illustrated in FIGS. 1 and 2 is provided with a socket joint 55 in which to receive proximal end 49 of forward body portion 45. As illustrated in FIG. 1, connection end 51 may incorporate a dog-leg, or offset, to permit folding rear body member 59 for storage in connected parallel proximity to forward member 45. Rear body member 59 may be characterized as an extension member to forward body member 45. In a folded state, the first embodiment 10 is about 12 inches long. Of course, it is realized that body members, and extension members, may be manufactured to any desired length. A catch, latch, tie, restraint, or other closure mechanism, (e.g. 103, FIG. 7), may be provided in some instances to maintain body portions 45 and 59 in folded proximity to each other.

A body 35 is also desirably made to be as small in diameter as is manufacturably convenient, to enable storage in a small space. The illustrated embodiment 10 is formed from copper tubing of about ½ inch diameter. Materials having less density and/or higher stiffness are preferable, although such is not a requirement for operability. For example, it is within contemplation for a retractor portion 20 to include a housing component that is injection molded from a plastic, or other suitable material. It is further within contemplation to make a body from smaller diameter tubing, such as ⅜ or ¼ inch diameter. Cross-sections having other shapes are also within contemplation. While the smallest diameter or cross-section shape is desirable, the body must maintain a sufficient section modulus (EI or Young's modulus times the area moment of inertia of a body cross-section) to resist excessive lateral deflection under the weight of a rope as a cam is placed at a distance. Body cross-sections need not be uniform along the length of the device. It has been found that transversely "squashing" the forward body 45 at a location distal to the window 43 is beneficial in both increasing the local stiffness of the device relative to a loaded direction, and in increasing the clearance between arms 37 and body 45.

An actuator portion 30 of a device constructed according to the instant invention is structured to operate the retractor portion 20. Any mechanism operable reliably to cause an increase and a decrease in length between hook 60 and socket 39, or shelf 41, would be workable. With reference to FIG. 1, a remote trigger 63 is associated with connection end 51 for extension and retraction of arms 37. Trigger 63 is regarded as being remote from the cam, but essentially replacing and remotely operating the cam's trigger. Trigger 63 is adapted to slide along a length of slot 64 and operate retractor portion 20 accordingly. Trigger 63 is therefore movable under finger actuation toward, and away from, a palm fitting 64 which forms a proximal end to body extension member 59. It is within contemplation to form a trigger 63 capable of folding, pivoting, telescoping, or otherwise adjusting, to a reduced transverse length, whereby to decrease the required storage space for a device.

Figure 5:
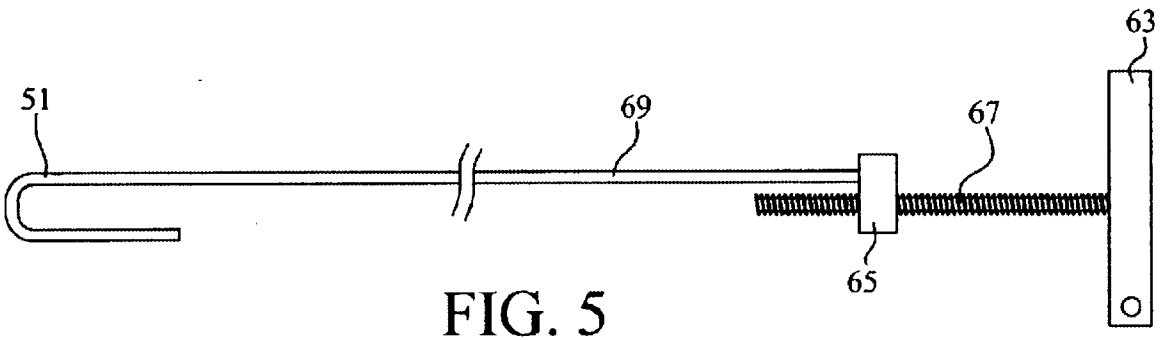
FIG. 5 is a plan view of an actuator portion of the embodiment of FIG. 1.

As illustrated in FIG. 5, provision for adjustment of a length between trigger 63 and connection end 51 may be included in a device constructed according to principals of the instant invention. In FIG. 5, a threaded nut 65 is placed in engagement along a threaded shaft segment 67, which is attached to trigger 63. An elongate member 69 is attached to nut 65, and extends therefrom to connection end 51. The retractor components illustrated in FIG. 5 may therefore be lengthened to fit to a larger cam, or shortened to fit to a smaller cam. Adjustments in the total length between end 51 and trigger 63 can be made by rotating a body member 59 which is assembled to a body 45, or by rotating connection end 51 directly, while holding body 59 stationary. Elongate member 69 may be made from a wire, or rod, having sufficient stiffness both to extend arms 37, and adequately to maintain a shape in connection end 51. A material similar to a coat hanger has been found to be workable. Elongate members 69 having other shapes and cross-sections are also workable, including straps, or sheet material.

Figure 3:
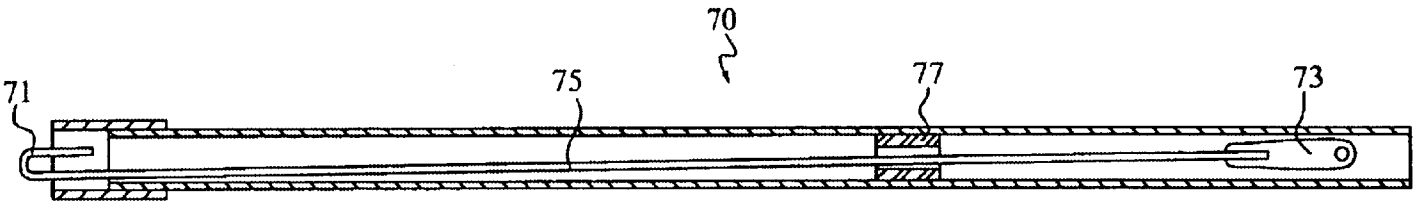
FIG. 3 is a plan view in section of an extension member for the embodiment of FIG. 1.

One or more body extension members, generally indicated at 70 (FIG. 3), may be provided to increase the distance at which a cam may be placed, or retrieved. When used in conjunction with forward body 45 and body extension 59: forward end 71 connects to end 47 of arms 37 at end 49 of body 45, and connection end 51 of body 59 connects to end 73. An elongate member 75 extends from connection ends 71 to 73. As an aid to prevent separation of constituent components, a stopper 77 may be included in an extension member 70. When present, stopper 77 is typically spaced apart from each end sufficiently so as not to interfere with a range of motion of retractor 20. Any number of extension members 70 may be assembled in-line between a forward and a rear portion of body 35 in a device 10 according to the instant invention. A device 10 may therefore be constructed having a reach sufficient to make a cam placement 15 or more feet further than a climber may reach with his/her arm.

When climbing, it is important not to drop anything, especially not tools used for placement and retraction of protection. To facilitate a climber in maintaining possession of the device, loops of material, such as illustrated cord 81 (FIGS. 1, 2), may be attached to various places on the device 10. Each separable member desirably will have its own attachment loop. A sling or other retaining cord may then be clipped to each member's attachment loop as each member is removed from a transport container, or handled individually. When used as a connected two-piece folding member, a split ring, or a short piece of cord, may be placed through hole 81 in trigger 63 (FIG. 5). The folded two-piece member may then be clipped to a climber's harness, or gear sling, with a carabiner and will hang and remain sufficiently out of the way until desired for assistance in placing or removing protection.

It is within contemplation for the device to include a carabiner clip, or stick-clip element, structured to permit use of the device as a stick-clipping tool to clip a carabiner to a bolt hanger which is out of reach of a climber's hand, or at an extended distance. One operable stick-clip element is a simple piece of white athletic tape wrapped around an open carabiner gate and securing the carabiner to an end of the retractor 20. Other, more elaborate, stick-clip elements are also within contemplation. For example, spring loaded clamps, self-biased plastic or resilient arms, and various latch mechanisms are workable stick-clip elements. The function of a stick-clip element is simply to hold the gate of a carabiner open until the carabiner is hooked to a bolt hanger, then desirably to release the carabiner and permit the carabiner's gate to close.

The device may also include various hooks and pokers to assist in repositioning cams for extraction either by trigger retraction, or by rotating the cam to face "backwards" for extraction by a hook without simultaneous cam retraction. In such case, yanking the hooked cam causes the individual cams to rotate as required to fit through the crack as the cam is slid out from the crack. In the latter case, the cam axle typically is the cam component that is hooked and on which the climber yanks to free the cam.

Figure 6:
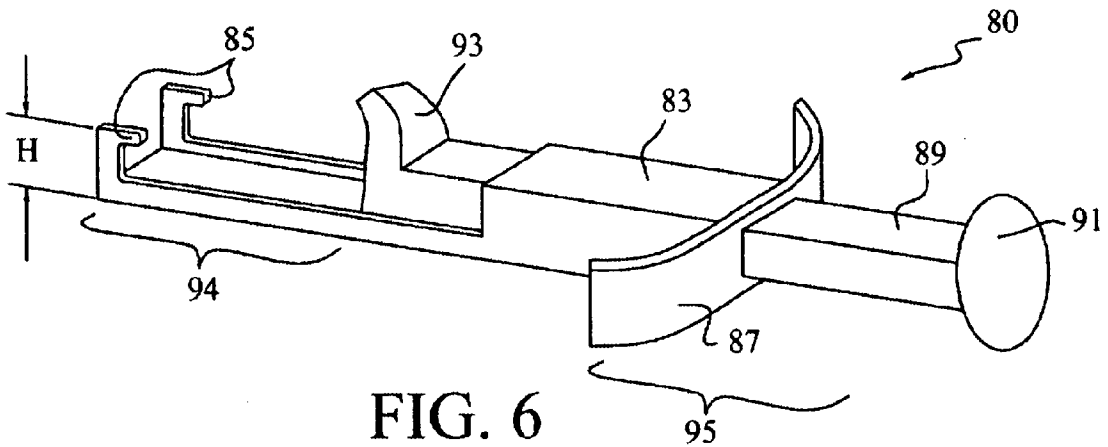
FIG. 6 PRIOR ART
FIG. 6 is a view in perspective of a prior art device.

FIG. 6 illustrates a prior art "Friend of a friend", generally indicated at 80. A body member 83 is formed from a square Aluminum tubing, and has integral hooks or fingers 85 disposed at a distal end. A remote trigger 87 is formed at a proximal end by folding portions of the tube wall outwardly. Plunger 89 carries a palm stop 91 on a proximal end, and a thumb-stop, or remote thumb, 93 at a distal end. A cam may be retracted by placing the hooks 85 in position on a cam's trigger with the cam's opposable stem portion or thumb-catch in position relative to thumb-stop 93, and then depressing plunger 89. Fingers 85 and thumb 93 form a retraction mechanism 94. Trigger 87 and palm stop 91 form a control interface 95 to receive control input from a human hand. Body 83 and plunger 89 form a constant-length linkage spacing retractor mechanism 94 apart from control interface 95. An advantage provided by the tubular body 83 is that the distance "H" may be minimized to permit use of the device in extraction of a cam from more narrow cracks.

Figure 7:
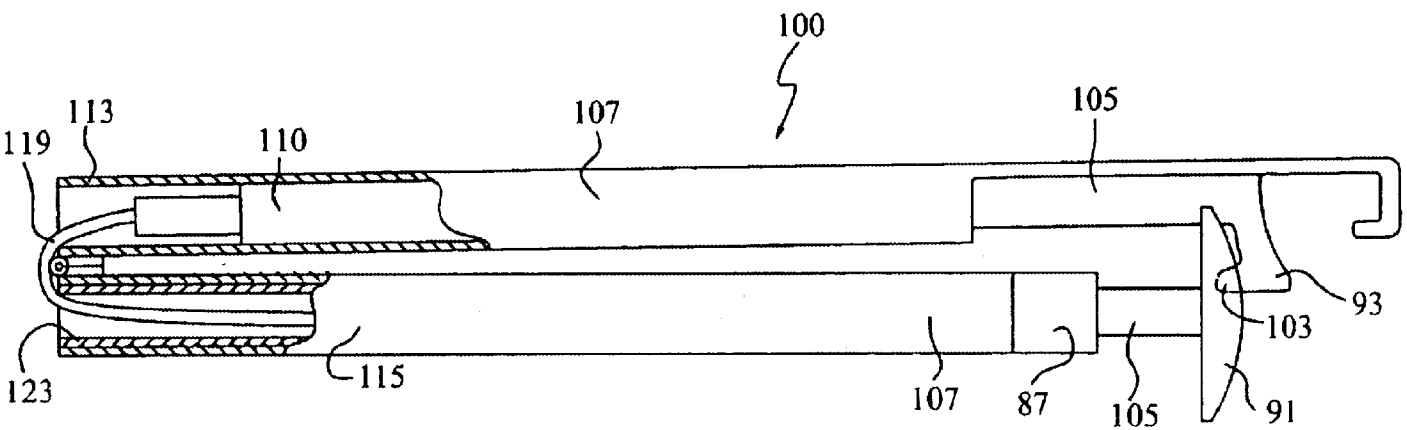
FIG. 7 is a plan view, partially in section, of a second embodiment of the invention.

A second embodiment of the instant invention is illustrated in FIG. 7, and is generally designated at 100. This device 100 has several details of construction in common with the prior art device 80 illustrated in FIG. 6. Improvements over the prior art permit the device 100 to be folded, or otherwise reduced in length, to form a conveniently short implement for transportation and storage, and then converted to a longer device for placement or extraction of a cam from an increased distance.

Changes over the prior art device 80 that are incorporated in the illustrated second embodiment 100 of the instant invention include modifications to the thumb-catch 93 to include a latch member 103 adapted for engagement with a recess in palm stop 91, as illustrated. Resilient member 119 can bias latch 103 into engagement with palm stop 91. Such a latching arrangement helps to maintain the illustrated device 100 in a folded configuration for transportation or storage. Illustrated palm stop 91 also has a notch in which to receive a distal portion of plunger 105 to maximize folding of the body 107 to occupy a minimum volume. The plunger 105 and body 107 can be made in two pieces, as illustrated, although provision of additional body members to increase a range in extended length is within contemplation.

As illustrated, a hinge 110 may be disposed between a forward body segment 113 and an aft body segment 115. Other mechanisms permitting separation of a body into a plurality of sub segments having a smaller storable length are within contemplation, nonexclusively including bayonet locks and twisting catches. A resilient member 119 can be disposed between forward plunger segment 121 and aft plunger segment 123. Resilient member 119 can be fashioned as a bungee cord, or other elastic element, to assist in assembly of the two segments when the tool is to be used in cam extraction or placement. Member 119 can also maintain the device as a connected assembly of subunits, helping to reduce dropped parts, even when deploying from a stowed (folded) configuration to a configuration suitable for cam actuation. When plunger segments 121 and 123 are engaged, body segments 113 and 115 are maintained in a straight alignment by plunger structure internal to the tubular body 107.

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope

What is claimed is:

1. An actuator device for use in retracting at least one cam element of a spring-loaded camming apparatus used in rock climbing, the device comprising:

a cam retractor configured and arranged to interface with a trigger of said camming apparatus for retraction of said at least one cam element; and a body comprising a forward member and a rear member configured cooperably on assembly therebetween to configure said body to have a first length wherein said forward member and said rear member can be arranged to configure said body to be reduced in length from said first length for transportation of said device, and a portion of said body being disposable between said retractor and an actuator operable on said retractor to permit a user of said device to move said cam retractor effective to retract said at least one cam element.

2. The device according to claim 1, said cam retractor comprising:

a pair of arms, each arm carrying a hook on a first end to interface with said trigger, each said arm passing through a window in said body such that a portion of said arm is disposed internal to said body, and a portion is external to said body.

3. The device according to claim 2, said actuator comprising a finger actuated remote trigger disposed at a proximal end of said rear member and being operable on said arms, said remote trigger being movable toward a stationary palm end fitting.

4. The device according to claim 3, further comprising an adjustable link disposed between said remote trigger and said arms, said adjustable link being adjustable to create a range in operable length between a said hook and a shelf of said retractor.

5. The device according to claim 4, further including a body extension member adapted at first and second ends for in-line connection between said forward member and said rear member.

6. The device according to claim 2, further comprising a plurality of body extension members, each body extension member being adapted at first and second ends for in-line connection between said forward member and said rear member.

7. The device according to claim 6, further including a stick-clip element disposed at a distal end of said device and being configured and arranged to hold a gate of a carabiner open for remote clipping of said carabiner to a bolt hanger.

8. The device according to claim 1, said cam retractor comprising a pair of arms being associated with said body.

9. The device according to claim 8, said body comprising a rectangular tube.

10. The device according to claim 8, said actuator comprising a palm actuated plunger movable toward a stationary remote trigger.

11. The device according to claim 10, further comprising an elastomeric member disposed between a forward plunger member and a rear plunger member, said elastomeric member being biased to assist in assembly of said plunger comprising said forward plunger member and said rear plunger for storage.

12. The device according to claim 11, a forward body member and a rear body member being hinged whereby to fold from an in-line configuration to an approximately parallel configuration.

13. An extractor for use in retracting at least one cam element of a spring-loaded camming device used in rock climbing, the extractor comprising:

a retraction mechanism comprising a remote finger and a remote thumb, said remote finger and said remote thumb being configured and cooperatively arranged operably to retract a trigger of a said spring-loaded camming device;

a control interface adapted to receive control input from a human hand to operate said retraction mechanism; and a linkage operable on and spacing said retraction mechanism apart from said control interface, said linkage being adjustable between a first length and a second length, said first length being longer than said second length.

14. The extractor of claim 13, said control interface comprising a trigger and a plunger.

15. The extractor of claim 14, said linkage comprising distal and proximal elements being foldable with respect to each other whereby to move from an in-line configuration to an approximately parallel configuration.

16. The extractor of claim 14, said linkage comprising distal and proximal elements being movable with respect to each other whereby to permit a change in element arrangement from an in-line configuration to an approximately parallel configuration.

17. The extractor of claim 14, wherein:

said linkage comprises:

a tension member arrangeable to act on said finger; and a compression member arrangeable to act on said thumb.

18. The extractor of claim 17, wherein a portion of said tension member is disposed interior to a portion of said compression member.

19. The extractor of claim 17, wherein a portion of said compression member is disposed interior to a portion of said tension member.

20. The extractor of claim 13, further comprising a stick-clip arrangement disposed at a distal end of said linkage and operable to hold a carabiner in a gate-open configuration for placing said carabiner into engagement with a piece of rock climbing protection located at a distance from a climber's outstretched hand.

* * * * *